United States Patent [19]

Vezirian

[11] Patent Number: 5,024,539

[45] Date of Patent: Jun. 18, 1991

[54] FRICTION BEARING AND CONE RETENTION THRUST SYSTEM FOR A ROCK BIT

[76] Inventor: Edward Vezirian, P.O. Box 215, Beaumont, Calif. 92223

[21] Appl. No.: 567,121

[22] Filed: Aug. 13, 1990

[51] Int. Cl.[5] ..... F16C 17/10

[52] U.S. Cl. ..... 384/92; 384/94; 384/96

[58] Field of Search ..... 384/92, 94, 96, 93, 384/95

[56] References Cited

U.S. PATENT DOCUMENTS

| | | | |
|---|---|---|---|
| 4,136,748 | 1/1979 | Dickerhoff | 384/92 |
| 4,395,076 | 7/1983 | Sabre | 384/92 |
| 4,555,186 | 11/1985 | Scruggs | 384/92 |
| 4,903,786 | 2/1990 | Welsh | 384/94 |

*Primary Examiner*—Lenard A. Footland

[57] ABSTRACT

A rotary rock cutter cone is rotatively supported while being axially located and retained on a cooperating cantilevered journal shaft depending from a rock bit body by plain friction bearing means.

A primary stationary thrust face is provided by a radially extending surface of the journal shaft adjacent the distal end of the journal shaft.

An annular ring, fitted about the journal shaft, forms a gland for housing a grease seal which impinges upon the journal shaft. A radially extending distal surface of the annular ring runs in cooperation with a radially extending stationary thrust face formed by a secondary thrust member. The secondary thrust member is axially secured to the journal shaft thus axially trapping the annular ring adjacent to the supported end of the journal shaft.

A radial bearing bore centrally enters the base of the cone and extends to a radially extending primary thrust bearing surface within the cone.

The annular ring is finally and rigidly secured within a counterbore formed about the bearing bore at the base of the cone.

5 Claims, 1 Drawing Sheet

FRICTION BEARING AND CONE RETENTION THRUST SYSTEM FOR A ROCK BIT

BACKGROUND OF THE INVENTION

1. Field of the Invention

The present invention relates generally to an improved rotary rock cutter-to-journal shaft retention and thrust bearing system, and, more specifically, to such a system which not only improves the retention and thrust bearing load carrying capabilities of such a system over the prior art, but which also accurately establishes and maintains a preselected axial position of the cutter upon the supporting journal shaft. Further, this invention substantially increases the potential effective size of the radial bearing footprint, thereby improving axial stability of the cutter about its shaft.

2. Brief Description of the Prior Art

Various retention and thrust bearing systems for rotary rock cutters mounted on a journal shaft are found in the prior art.

One example of such a prior art system is found in U.S. Pat. No. 3,620,580 by Cunningham, which describes and analyzes in some detail the use of steel bearing balls arranged in a pair oppositely-disposed complementary deep ball races. One such ball race is formed in the bore of the cutter, and the other is formed in the surface of the journal shaft. The ball races are relieved so that only those retention and thrust loads which are directed radially inward, relative to the bore hole, are imposed upon the balls, and radial loads are never imposed upon the balls.

When placed under operational conditions, the balls are loaded in shear against the relatively sharp edges of the rims of the ball races. Under the extremely heavy shock loads encountered in well drilling, the sharp edges of the ball races fail by spalling away. Such spalling is not only destructive with respect to the balls and races, but also is productive of metallic debris whereby the entire bearing structure and lubrication system of the cutter-shaft combination is disadvantaged.

Further, it should be clearly understood and appreciated that within a rotary rock bit, space is at an extreme premium. A retention and thrust bearing system based upon balls occupies a relatively large volume of space while providing a very limited bearing capacity, because the loads are concentrated upon small contact areas of both balls and races.

Another system is described in U.S. Pat. No. 2,076,003 issued to Reed, which teaches the use of a number of disks resembling thick coins which are half housed in a square groove formed within the rotary rock cutter while the remaining halves ride against a radially-extended flange formed on the surface of the journal shaft.

While the retention strength of this configuration is relatively high, being equal to the shearing strength of the disks taken across the sum of their diameters, the system is disadvantaged in that it occupies a volume of space comparable to that occupied by the ball system of Cunningham. It is further disadvantaged in that the structural support of the cantilevered journal shaft is seriously weakened at the critically loaded leg-to-journal shaft junction, by the removal of a large radial segment of metal in order to permit assembly.

In U.S. Pat. No. 2,192,697 by Scott, a rotary rock cutter and journal shaft retention and thrust bearing system is disclosed which uses a primary roller radial bearing, and a secondary friction radial bearing with a radially extending flange formed by the journal shaft disposed in between. The secondary friction bushing is split longitudinally and fits into an annular groove formed in the surface of the journal shaft. This bushing has an annular rectangular groove formed in its outside diameter which compliments a similar groove formed in the rotary rock cutter, the pair being adapted to receive a thick snap ring. The snap ring is compressed to be loaded into the groove in the rotary rock cutter, the groove being oversize. The bushing outside diameter is tapered smaller at its distal end to facilitate entry into the snap ring at assembly.

Although the thrust bearing capacity of this design is adequate, the radial bearing capacity is low considering the inefficient use of space of both the rollers and the thick bushing.

A thrust bearing and retention design is disclosed by Boice in U.S. Pat. No. 2,661,322 which uses a complement of tapered rollers as conventionally used in roller thrust bearings.

Although the bearing capacity of this system is better than the capacity of the Cunningham system, it is substantially less than is provided by such a system as, for example, Reed. In the Boice system, thrust loads in either direction serve to put the larger end of the rollers into hard frictional contact with the outside diameter of the race formed in the rotary rock cutter, and thus against the retaining member used to block the loading hole which is formed through the outer working surface of the rock cutter. This hole through the outer surface of the rock cutter is sealed after assembly by welding. Welding is to be avoided, as a practical matter, in that such a process causes a loss of control of critical internal dimensions through warpage and distortion, and the wear resistant surface generated by heat treat processes is seriously disrupted by the welding process. Such a welded spot disrupts the integrity of the formerly single piece, metallurgically-uniform, rock cutter body and the strength of the rotary rock cutter by the introduction of undesirable stress risers in the rotary rock cutter body.

Another approach is taught in U.S. Pat. No. 2,823,083 by Welton. In this approach, symmetrical complementary 45 degree "V" grooves are formed respectively in rock cutter bore and journal shaft surface. Alternating crossed rollers which are of a length slightly less than their diameter are disposed in the opposing grooves in a configuration commonly known as a "crossed roller bearing". Such bearings are generally used to carry primary radial or linear loads along with minor thrust loads in either direction.

In this particular design, the radial capacity is helpful to compensate in part for the substantial loss of radial bearing length incurred in its use. While retention strength is relatively high in this system, being equal to the shear strength of the sum of the rollers taken diagonally through their bodies, it is disadvantaged by low thrust load capacity. Thrust loads are borne by only half of the rollers at any time, and then only indirectly at the 45 degree angle.

Yet another system is described in U.S. Pat. No. 3,361,494 by Galle. This patent is directed to a journal shaft having a shape like an arrowhead of revolution, with a truncated point and relatively small barbs. This arrowhead-like shape is reproduced in the rotary rock cutter bore. A large secondary cylindrical cut is taken on the upper unloaded side of the journal shaft tapering from mere contact at the proximal end of the shaft to a depth of about two "barb heights" at the barb location, and having substantially the same radius as the basic journal shaft. This permits assembly of the cutter over the remaining lower barb by tipping the vertex of the conical cutter downward during the start of assembly, then upward to alignment with the journal shaft when it is fully in place thereon. A retention pin having an end resembling the missing barb is then positioned through a small angled bore formed through the journal shaft to retain the cutter in place by partially replacing the missing barb.

In this arrangement, thrust loads are supported by a narrow area of contact with the barb on the lower loaded side of the journal shaft, a point contact with the retaining pin at the upper side of the journal shaft, and virtually no contact at all on the sides of the journal shaft. It is clearly a disadvantage of this system that something over fifty (50) percent of the journal shaft is machined in relief and thus can not bear any load at all.

Welton, in U.S. Pat. No. 3,746,405, describes a retention system based on a stout split snap ring. Proportioned as pictured, the radial bearing is enlarged in diameter, but not in length. As a result, the thrust load bearing capacity is relatively low and the ultimate retention strength is relatively high. Because of this limitation, this design is thought not to have been used commercially.

Vezirian discloses a system in U.S. Pat. No. 4,145,094 based upon a thick bushing which provides both radial and thrust bearing surfaces, a grease reservoir, and a retention device. This bushing is split longitudinally into three sections, one of which is reduced in outside radius. The inside radii of all three sections closely fit the uniform diameter of the journal pin. The thin section provides a grease reservoir and facilitates assembly of the three sections into an annular recess in the rotary rock cutter bore where they provide twin thrust bearing surfaces, and the radial bearing surface is provided by the two thicker sections. At assembly, the straight journal pin is passed throug closely fitting bores in the split bushing and in the supporting leg. With the thin section of the bushing positioned on the unloaded upper side of the journal shaft, an electron welding beam is passed circumferentially around the journal pin thus welding the pin to the three sections of the split bushing and to the supporting leg.

The journal pin is substantially less in diameter than is the journal bearing, thus providing a weak cantilever support for the cutter assembly. Even with the fast efficient electron beam welding, the surrounding grease seal may be thermally damaged by the process.

U.S. Pat. No. 4,176,724 by Vezirian teaches the assembly of the necessary structures by means of an electron welding beam passing through a small hole in either the journal shaft or the rotary rock cutter. A segmented retaining ring having a rectangular cross section is welded to the member not bearing the access hole by rotating the cutter relative to the journal shaft while the welding is being accomplished. Finally the access hole is closed by a threaded plug or by welding.

In U.S. Pat. No. 4,266,622 issued to the same inventor a further refinement in the electron beam assembly process is disclosed. In this system a headed journal bearing bushing is captured in the rotary cutter bore by welding in a mating bearing bushing providing radial and thrust bearing surfaces therebetween. Then a straight bearing pin passing through both the supporting leg and the inner bushing is welded to both members by the electron beam. This design shares the weakness of the cantilever mentioned in the previous patent.

Another rock cutter retention system containing a wire split snap ring of very light circular cross-section is used in U.S. Pat. No. 4,344,658 by Ledgerwood. This wire ring is loaded into a journal shaft groove having a distal side flaring conically outward. At assembly the wire ring expands into a semi-circular groove in the rotary rock cutter to a depth just over one half of the wire diameter. In-thrust loads reacting against the conical outer wall of the groove in the shaft serve to seat the wire ring ever more tightly in the groove in the rotary cutter. Both thrust capacity and retention strength in this system are very low. Furthermore, just as in the ball retention system of Cunningham, the design is disadvantaged by the impression of these loads upon sharp edges of the retaining grooves which leads to the rapid formation of undesirable detritus within the lubricated bearing system and results in a weak axial location of the rotary cutter and contributes to early cone wobble.

Various other patents exist for retention systems which are of lesser interest due to such various problems as the uneconomical use of cutter internal space, low thrust capacity, poor retention support, or excess complexity for use in the difficult drilling environment. Examples of such prior art are represented by: U.S. Pat. Nos. 4,181,377 by Oelke, 2,697,014 by Boice, 3,193,028, by Radzimovsky, 4,136,748 by Dickerhoff, 4,157,122 by Morris, and 4,444,518 by Schramm, et al.

SUMMARY OF THE INVENTION

In this invention, a system is devised to axially locate and to retain a rotating member upon a shaft.

An object of this invention is to provide a rotary cone rock bit with a more durable bearing system capable of supporting large forces tending to cant or to axially displace the cone relative to the journal shaft, and to tightly restrict the amplitude of such displacements.

Another object of this invention is to provide a sound and accurately predetermined axial location of the rotary rock cutter upon the journal shaft. Such a positioning of the cutter is important to maintain control of the well bore diameter produced by the rock bit.

In a rotary cone rock bit, a cantilevered journal shaft extends downwardly and radially inward from the lower side of a structural rock bit body rotatively supporting a rock cutting cone. The journal shaft forms an axially extending radial load bearing surface extending to a radially extending primary thrust bearing surface which is formed adjacent to the distal end of the shaft.

An annular ring is fitted about the shaft. This ring forms a gland internally housing a grease seal which impinges the shafts radial surface adjacent to the fixed end of the journal shaft. A radially extending distal surface of the annular ring provides a secondary thrust bearing surface which runs cooperatively against a matching radially extending surface of a secondary thrust member. The secondary thrust member is axially located and secured along the radial surface of the journal shaft, thus axially trapping the annular ring adjacent to the supported end of the journal shaft.

A rotary rock cutting cone features a radial bearing bore which enters the base of the cone centrally and extends to a radially extending primary thrust surface within the cone. A counterbore surrounding the radial bearing bore is also formed by the cone.

At assembly, the annular ring is rigidly secured within the counterbore of the cone. The rock cutting cone is thus rotatively supported by the radial bearing portion of the journal shaft, and at the same time is axially located between the primary and the secondary thrust bearing couples formed by the radially extending surfaces discussed above.

The annular ring is rigidly secured within the counterbore formed by the cone by any appropriate means, for example a buttress thread. Such a thread may provide a leakage path allowing drilling fluids to enter the lubricated bearing space around the grease seal. In this case a secondary static seal is employed between the annular ring and the counterbore formed by the cone.

Radial bearing bushings may be desired, for example to extend the choices of bearing couple materials. It should be understood that such bushings may be employed within the scope of this invention. If an outside bushing is required, it may be formed as a distal extension of the annular ring. In this case the distal end of the bushing portion of the annular ring forms the radially extending secondary thrust bearing surface. The annular ring, and the bushing so formed is a part of the cone after assembly, and rotates with the cone.

Should a bushing be desired associated with, or as a part of, the journal, it may be an adaptation of the secondary thrust member. That is to say that the secondary thrust member may be a bushing in fact, and be secured to the journal shaft. In this case the radially extending secondary thrust bearing surface is formed by the proximal end of the radial bearing bushing adjacent to the secondary thrust surface of the annular ring.

Thrust bearing surfaces may be equipped with other material choices by supplying appropriate washers between cooperating thrust faces without departing from the scope of this invention.

An additional advantage found in the practice of this invention and resulting directly from the increase in axial rigidity is an increase in the capacity to maintain control of the well bore diameter. When a cutter is capable of wobble or displacement about its supporting journal shaft then control of the well bore diameter is lost.

The above noted objects and advantages of the present invention will be more fully understood and appreciated upon a study of the following description in conjunction with the detailed drawings.

DESCRIPTION OF THE PREFERRED EMBODIMENTS AND BEST MODE FOR CARRYING OUT THE INVENTION

Figure 1:
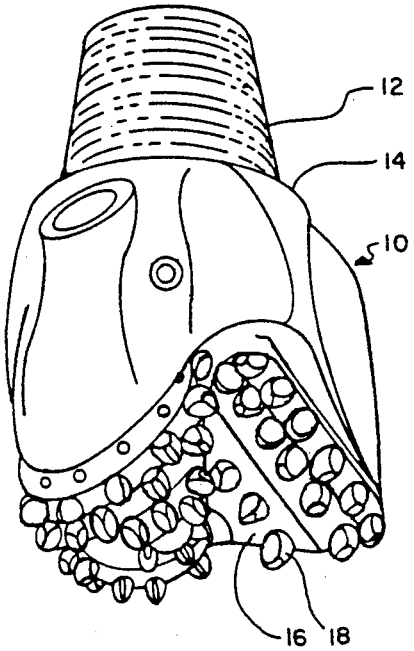
FIG. 1 is a perspective view of a three cone rotary rock bit.

A three cone rotary rock bit is depicted in FIG. 1. The appearance of the product is not materially different from prior art rotary rock bits as a result of practicing this invention. The structural body of the rock bit, generally indicated as 10, has a tapered threaded nipple 12 which extends upward from machined flange 14. The threaded nipple is used to secure the rock bit to a drill line for use in boring a well. Body 10 supports cantilevered journal shafts (not shown) extending downwardly and radially inward which rotatively support rock cutting cones 16 carrying hard rock cutting teeth 18.

Figure 2:
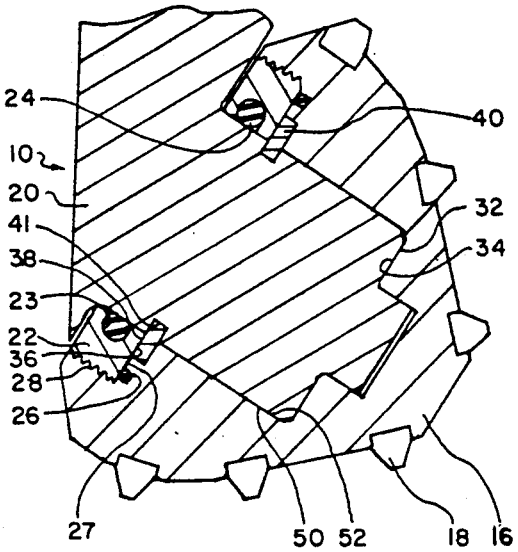
FIG. 2 is a cross-section taken through a cone and journal assembly showing the bearing features as described.

In FIG. 2, a portion of a rock bit structural body, generally indicated as 10, supports cantilevered journal shaft 20. Radially extending surface 32 of the distal end of journal shaft 20 provides the primary stationary thrust surface. Annular ring 22 which forms gland 23 housing grease seal 24 which impinges journal shaft 20 adjacent to the supported end of journal shaft 20. Radially extending surface 36 of annular ring 22 runs as a thrust bearing against radially extending surface 38 of secondary thrust member 40. Secondary thrust member 40 is axially located and secured along the radial surface 50 of journal shaft 20. In FIG. 2 secondary thrust member 40 is shown placed in groove 41 formed in radial surface 50 of journal shaft 20, secondary thrust member 40 being a split ring in this instance. It should be realized that the secondary thrust member 40 could as well be secured to journal shaft 20 by any other appropriate means, such as welding for example. Rock cutting cone 16, carrying hard rock cutting teeth 18, forms a radial bearing bore 52 which enters the center of the base of cone 16 and extends to radially extending primary thrust surface 34 within cone 16. Annular ring 22 fills counterbore 27 formed by cone 16 about radial bearing bore 52, and is rigidly secured within counterbore 27 by buttress thread 28. Any other appropriate means may be used to secure annular ring 22 into counterbore 27, of course. Static seal 26 between annular ring 22 and counterbore 27 is used to prevent fluid passage past buttress thread 28 in to or out of the internal bearings circumventing grease seal 24. Axially extending radial surfaces 50 (of journal shaft 20) and 52 (of cone 16) cooperate to bear radial loads. Cone 16 is axially located and retained on journal shaft 20 by the primary thrust bearing in one axial direction, and by the secondary thrust bearing in the opposite axial direction. The primary thrust bearing is comprised of the radially extending surface 32 of journal shaft 20, and the cooperating radially extending surface 34 of cone 16. The secondary thrust bearing is comprised of the radially extending surface 36 of annular ring 22, and the cooperating radially extending surface 38 of secondary thrust member 40.

Figure 3:
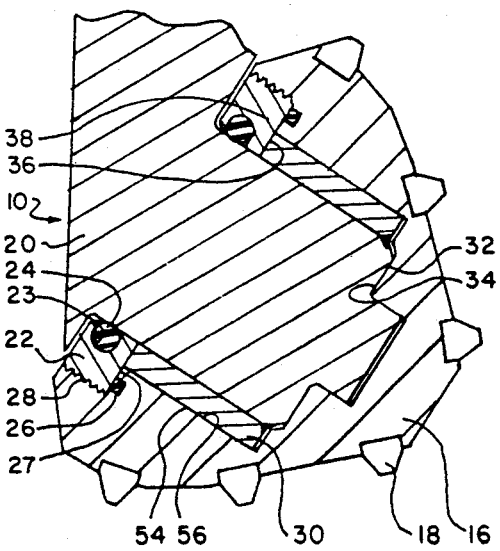
FIG. 3 is similar to FIG. 2 showing an embodiment wherein the secondary thrust member is a radial bearing bushing secured to the journal shaft.

FIG. 3 illustrates another embodiment of the invention wherein the secondary thrust member 30, forming radially extending thrust surface 38 also provides a radial bearing bushing associated with journal shaft 20. Secondary thrust member 30 is axially located and secured both axially and radially to journal shaft 20. Axially extending radial surfaces 54 (of secondary thrust member 30) and 56 (of cone 16) cooperate to bear radial loads. All other features and numerical indicators are the same as found in FIG. 2.

Figure 4:
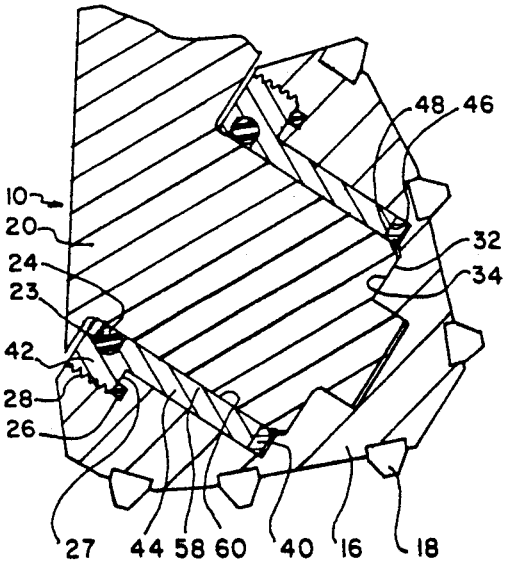
FIG. 4 is a cross-sectional view similar to FIG. 3 wherein the annular ring is extended to provide a radial bearing bushing associated with the cone, and the secondary thrust member is located adjacent to the distal end of the journal shaft, being secured to the journal shaft.

In FIG. 4 an embodiment is illustrated wherein annular ring 42 is extended to form a radial bearing bushing 44 which is associated with and secured to the cone. The secondary thrust member 40 forming radially extending thrust face 48 is axially located and secured to the journal shaft 20 adjacent to the distal end of journal shaft 20. Thrust face 48 runs in cooperation with radially extending surface 46 formed by annular ring 42 at the end of the radial bearing bushing extension 44. Axially extending radial surfaces 58 (of journal shaft 20) and 60 (of annular ring 42) cooperate to bear radial loads. All other features and numerical indicators are the same as found in FIG. 2.

It will of course be realized that various modifications can be made in the design and operation of the present invention without departing from the spirit thereof. Thus, while the principal construction and mode of operation of the invention have been explained in what is now considered to represent its best embodiments, which have been illustrated and described, it should be understood that within the scope of the appended claims, the invention may be practiced other than as specifically illustrated and described.

I claim:

1. A friction bearing and cone retention thrust system for a rock bit comprising:

a cantilevered journal shaft depending from a structural body of a rotary cone rock bit, said journal shaft extending downwardly and radially inward from said structural body, said journal shaft forming an axially extending radial bearing surface and forming a radially extending primary thrust bearing surface adjacent a distal end of said journal shaft, an annular ring about said journal shaft adjacent a fixed end of said journal shaft, said annular ring forming a gland housing a grease seal, said grease seal impinging said journal shaft, a distal side of said annular ring forming a radially extending secondary thrust bearing surface, a secondary thrust member extending about said journal shaft, said secondary thrust member forming a radially extending thrust bearing surface adjacent said secondary thrust bearing surface of said annular ring, said secondary thrust member being axially located and secured to said journal shaft so as to trap said annular ring about said journal shaft, a rock cutting cone, said rock cutting cone forming a bearing bore centrally entering base of said cone, said bearing bore extending to a radially extending primary thrust surface within said cone, said cone forming a counterbore about said enterance of said bearing bore, means to rigidly secure said annular ring within said counterbore formed by said cone, said cone thus being axially located on said journal shaft between said primary and said secondary thrust surfaces.

2. The invention as described in claim 1 wherein a static seal is positioned between said annular ring and said counterbore formed by said cone.

3. The invention as described in claim 1 wherein said means to rigidly secure said annular ring within said counterbore is a buttress thread.

4. The invention as described in claim 1 wherein said secondary thrust member is axially extended to provide a radial bearing bushing, said radial bearing bushing being secured to said journal shaft.

5. The invention as described in claim 1 wherein said annular ring is distally extended to provide a radial bearing bushing, said radial bearing bushing being secured to said rock cutting cone.

* * * * *